US009901930B2

(12) United States Patent
Ha

(10) Patent No.: US 9,901,930 B2
(45) Date of Patent: Feb. 27, 2018

(54) CONE SHAPED CRUSHER

(71) Applicant: Yong-Gan Ha, Chungcheongbuk-do (KR)

(72) Inventor: Yong-Gan Ha, Chungcheongbuk-do (KR)

( * ) Notice: Subject to any disclaimer, the term of this patent is extended or adjusted under 35 U.S.C. 154(b) by 195 days.

(21) Appl. No.: 14/772,073

(22) PCT Filed: Mar. 8, 2013

(86) PCT No.: PCT/KR2013/001887
§ 371 (c)(1),
(2) Date: Sep. 2, 2015

(87) PCT Pub. No.: WO2014/137013
PCT Pub. Date: Sep. 12, 2014

(65) Prior Publication Data
US 2016/0008818 A1 Jan. 14, 2016

(51) Int. Cl.
*B02C 2/00* (2006.01)
*B02C 2/04* (2006.01)
*B02C 2/06* (2006.01)

(52) U.S. Cl.
CPC ..... *B02C 2/047* (2013.01); *B02C 2/06* (2013.01)

(58) Field of Classification Search
CPC ..... B02C 2/047; B02C 2/06
USPC ..... 241/207–216
See application file for complete search history.

(56) References Cited

U.S. PATENT DOCUMENTS

| | | | | |
|---|---|---|---|---|
| 4,478,373 | A | 10/1984 | Gieschen | |
| 9,050,600 | B2 * | 6/2015 | Ha | B02C 2/04 |
| 2010/0155512 | A1 | 6/2010 | Persson et al. | |
| 2011/0309176 | A1 | 12/2011 | Kuvaja | |

FOREIGN PATENT DOCUMENTS

| | | | |
|---|---|---|---|
| JP | 46-036788 | | 1/1973 |
| JP | 50-084960 | A | 7/1975 |
| JP | 04-260453 | A | 9/1992 |
| KR | 100809900 | B1 | 3/2008 |
| KR | 101198584 | B1 | 11/2012 |
| WO | 2009065995 | A1 | 5/2009 |

(Continued)

OTHER PUBLICATIONS

Japanese Office Action for corresponding Japanese Patent Application No. 2015-560082 dated Sep. 13, 2016.

(Continued)

*Primary Examiner* — Faye Francis
(74) *Attorney, Agent, or Firm* — Hauptman Ham, LLP

(57) ABSTRACT

The present disclosure relates to a cone-shaped crusher. The cone-shaped crusher includes a main shaft, a mantle core assembly which is coupled to and movable up and down the main shaft, and a crushing gap control support positioned below the mantle core assembly and fixed to the main shaft. In addition, the crushing gap control support has an annular cylindrical unit extending upward therefrom and receiving a piston unit which extends downward from the mantle core assembly so that the piston unit is movable up and down in the cylindrical unit. The whole mantle core assembly formed with the piston unit moves up and down by a pressure of hydraulic oil flowing in and out of an internal space of the cylindrical unit.

14 Claims, 3 Drawing Sheets

(56) References Cited

FOREIGN PATENT DOCUMENTS

| | | | |
|---|---|---|---|
| WO | 2012/141559 | A1 | 10/2012 |
| WO | 2012/141560 | A1 | 10/2012 |
| WO | 2012141558 | A1 | 10/2012 |

OTHER PUBLICATIONS

Chinese Office Action for corresponding Chinese Patent Application No. 201380074416.1 dated Sep. 21, 2016.
European Search Report dated Apr. 19, 2016 in connection with the corresponding European Application No. 3877061.5.
International Search Report for PCT/KR2013/001887 dated Aug. 1, 2013.

* cited by examiner

CONE SHAPED CRUSHER

CROSS REFERENCE TO RELATED APPLICATION

This application is the National Phase application of International Application No. PCT/KR2013/001887 filed Mar. 8, 2013, which designates the United States and was published in Korean.

TECHNICAL FIELD

The present disclosure in one or more embodiments relates to a cone-shaped crusher. More particularly, the present disclosure relates to a cone-shaped crusher of which crushing gap is adjustable.

BACKGROUND

Cone-shaped or conical crushers are imperative crushing machines for a wide variety of uses in aggregate industries and mineral processing industries. Conical crushers have been developed into various structures and types.

International patent publication No. WO2009/065995 (hereinafter called 'prior art 1') discloses a typical structure of a cone-shaped crusher which includes a frame having a cavity formed therein, a first crushing blade provided inside the frame, a main shaft eccentrically accommodated in the frame, a truncated cone-shaped crusher head coupled to an outer circumferential surface of the main shaft, a second crushing blade that covers the surface of the crusher head, a top bearing part coupled to an upper end of the main shaft, a lower bearing part coupled to a lower end of the main shaft, and driving means for driving the main shaft into a gyratory movement.

Here, the first crushing blade is spaced apart at a proper distance from the second crushing blade mounted on an outer circumferential surface of the crusher head. Objects to be crushed that are put into the cone-shaped crusher are discharged toward the outside of the machine while being compressed and crushed as the gap between the fixed first crushing blade and the second crushing blade that performs the gyratory movement with the main shaft is reduced, and falling as the gap between the two blades increases in turn.

To meet various sizes of rock being introduced, the crushing gap of prior art 1 can be adjusted by moving the crusher head up or down.

To be more specific, the crusher head is movable in the longitudinal direction of the main shaft and has an internal cylindrical cavity with a small diameter portion and a large diameter portion. In addition, the main shaft is formed to have a small diameter portion and a large diameter portion to be inserted into the internal cavity of the crusher head.

The crusher head can move up and down along the main shaft by adjusting the amount of hydraulic fluid that is injected into a hydraulic space which is formed between the upper surface of the large diameter portion of the main shaft and the bottom surface of the small diameter portion of the crusher head.

In order for the crusher head to be able to move along the main shaft, a certain amount of gap should be present between the inner surface of the crusher head and the outer surface of the main shaft. Therefore, the diameter of the cavity of the crusher head which has a small diameter portion and a large diameter portion is larger than that of the opposing outer surface of the main shaft.

Thus, the crusher head and the main shaft perform the same gyratory movement while crushing objects, but relative rotational motions of the crusher head and the main shaft occur as the gyratory movement proceeds.

In greater detail, each of the small diameter portion and the large diameter portion of the cylindrical cavity of the crusher head has a tendency to rotate relatively to the surface of the small diameter portion and the large diameter portion of the main shaft independently. If the gap between the two small diameter portions of the crusher head and the main shaft equals to the gap between two large diameter portions of the crusher head and the main shaft, the small diameter portion of the crusher head needs to rotate at a faster angular velocity than its larger diameter portion so that the small diameter portion of the crusher head and its large diameter portion can rotate at the same linear velocity.

Since the crusher head is a rigid body, its small diameter portion and large diameter portion are supposed to rotate at a single angular velocity. Thus a slip friction at least on one of the surfaces of the small and large diameters is inevitable.

The relative rotational movement of the crusher head and the main shaft is slow, but since the rotational force is very strong, the sliding friction destroys the surfaces of the crushing head and main shaft.

Damaged and roughened surface breaks the hydraulic seal, resulting in a rapid leak of the hydraulic fluid. Therefore, the inner surface of the crusher head should be coated with lubricious material or a liner of a lubricious material should be installed on it.

However, since the crusher head is exposed to extremely irregular shocks resulted from crushing of rocks or other objects, the lubricious coating or the lubricious liner can only alleviate just the surface damage due to a sliding friction, and cannot prevent sliding friction itself, thus the liner of lubricious material is also subject to gradual wear. Moreover, since a crusher head has heavy weight and large bulk, the lubricious coating or the installation of the liner of lubricious material are quite difficult and require high cost.

In order to resolve the deficiency of such conical crusher, the inventor of the present invention has filed a PCT application (WO2012/141558: hereinafter called 'prior art 2') of a disclosure related to a cone-shaped crusher wherein a mantle core (corresponding to the crusher head of prior art 1) has a vertically extended key groove formed on its inner circumferential surface of a cylindrical space and a main shaft has a key groove formed on its outer circumferential surface, wherein a key is inserted.

Prior art 2 allows the mantle core to move smoothly along the longitudinal direction of the main shaft, while restraining the relative rotational motion between the mantle core and the main shaft. Meanwhile, prior art 2 discloses an arrangement that a lower portion of the main shaft has a fixed crushing gap adjustment plate on which a plurality of hydraulic pressure jacks for providing hydraulic power to move the mantle core along the longitudinal direction of the main shaft is installed.

According to the prior art 2, as described above, the mantle core can suppress a relative rotation of the main shaft by the key and key groove. However, impacts resulted from crushing the rock are continuously delivered to the key and key groove, and the stresses are concentrated on them and weaken their rigidity and even impair the structural strength of the main shaft itself.

DISCLOSURE

Technical Problem

The object of present invention is to solve the above deficiencies of the prior arts and provides a cone-shaped crusher which is free of the risk of surface breakage due to the sliding friction between the mantle core and the main shaft.

Another object of the present invention is to provide a cone-shaped crusher requiring no key and key groove to be formed between the mantle core and the main shaft.

In addition, yet another objective of the present invention is to provide a cone-shaped crusher that can reduce possible leakage of highly pressurized hydraulic fluid when used for adjusting the crushing gap.

Moreover, still another objective of the present invention is to provide a cone-shaped crusher having such structure that can reduce the influx of foreign matter such as dust in the gap between the mantle core and the main shaft.

In addition, still another objective of the present invention is to provide a cone-shaped crusher having a structure which can substantially reduce the mechanical friction of the contact surfaces of the mantle core and the main shaft.

Moreover, still another objective of the present invention is to provide a cone-shaped crusher with a prolonged service life.

SUMMARY

A cone-shaped crusher according to at least one embodiment has a frame with a cavity formed therein, a main shaft disposed in the cavity of the frame eccentrically from a center axis of the frame to perform a gyratory movement, a mantle core assembly which is coupled to the main shaft to perform the common gyratory movement with the main shaft, and movable along the axis of the main shaft for the control of crushing gap. In addition, the cone-shaped crusher comprises a crushing gap control support positioned below the mantle core assembly and fixed to the main shaft; an annular cylinder surrounding the outside of the main shaft and extending from the crushing gap control support toward the lower surface of the mantle core assembly; and a piston unit configured to be in a fixed relative position with respect to the mantle core assembly, formed at the lower portion of the mantle core assembly, inserted in the cylinder, and movable up and down by the pressure of hydraulic oil flowing in and out of internal space of the cylinder.

One or more hydraulic oil passages, which are in direct communication with the internal space of the cylinder or in communication with the internal space of the cylinder via the crushing gap control support, are internally formed in the main shaft.

The cone-shaped crusher may further comprise seal members provided on the outer peripheral surface and on the inner peripheral surface of the lower end of the piston unit to prevent leakage of hydraulic oil.

The mantle core assembly may be provided with a mantle core comprising more than one piece assembled.

The cone-shaped crusher may further comprise a mantle core sleeve interposed between the mantle core assembly and the main shaft.

The mantle core sleeve may have a flange which contacts and covers the bottom surface of the piston unit.

The cone-shaped crusher may further comprise a suspension bearing seal members provided on each of an outer peripheral surface and an inner peripheral surface of a lower end of the flange to prevent a leakage of hydraulic oil.

In order to prevent inflow of foreign matters to the cylinder and the piston unit, the cone-shaped crusher may further comprise a first dust seal sleeve having a larger diameter than that of the cylindrical unit and extending from the crushing gap control support toward the lower surface of the mantle core assembly; and a second dust seal sleeve extending from the lower surface of the mantle core assembly toward the crushing gap control support and surrounding the outer circumferential surface of the first dust seal sleeve.

To prevent inflow of foreign matters between the main shaft and the mantle core assembly, the cone-shaped crusher may further comprise a tire-shaped sealer which has an upper inner diameter portion being in contact with the outer circumferential surface of the main shaft and a lower inner diameter portion fixed to the upper end of the mantle core assembly.

The cone-shaped crusher may further comprise a clamp for fixing the lower inner diameter portion of the tire-shaped sealer to the upper end of the mantle core assembly.

The mantle core assembly may have a mantle core mounted on the main shaft, a mantle for externally covering the mantle core, and a least one lock nut for fastening the mantle to the mantle core. In addition, the lower inner diameter portion of the tire-shaped sealer may be compressed in place between the lock nut and the clamp.

Irregularities may be formed on at least one of a surface of the lock nut in contact with the lower inner diameter portion of the tire-shaped sealer and a surface of the clamp in contact with the lower inner diameter of the tire-shaped sealer.

Lubricant may be provided in a space defined by the tire-shaped sealer and the main shaft.

The cone-shaped crusher may further comprise an eccentric driver configured to drive the main shaft to be eccentrically offset from a center axis (Y) of the frame; and a main shaft driving means configured to rotate the eccentric driver to generate gyratory movement of the main shaft.

Advantageous Effects

The present disclosure provides a cone-shaped crusher with the following advantages.

(1) Free of the risk of surface damage due to the sliding friction between the mantle core and the main shaft.

(2) Obviating the need for a key and a key groove between the mantle core and the main shaft.

(3) Low probability of leakage of highly pressurized hydraulic fluid for adjusting the crushing gap.

(4) Structured for reducing the influx of foreign matter such as dust in the gap between the mantle core and the main shaft.

(5) Structured for substantially reducing the mechanical friction of the contact surfaces of the mantle core and the main shaft.

(6) Improved longevity of the cone-shaped crusher.

DESCRIPTION OF DRAWINGS

The following drawings appended to the present description illustrate preferable embodiments of the invention, and serve to make the technical ideas of the invention more clearly understood together with the detailed description of the invention. Thus, the invention should not be limited and interpreted as the contents set forth in the drawings.

DETAILED DESCRIPTION

Figure 1:
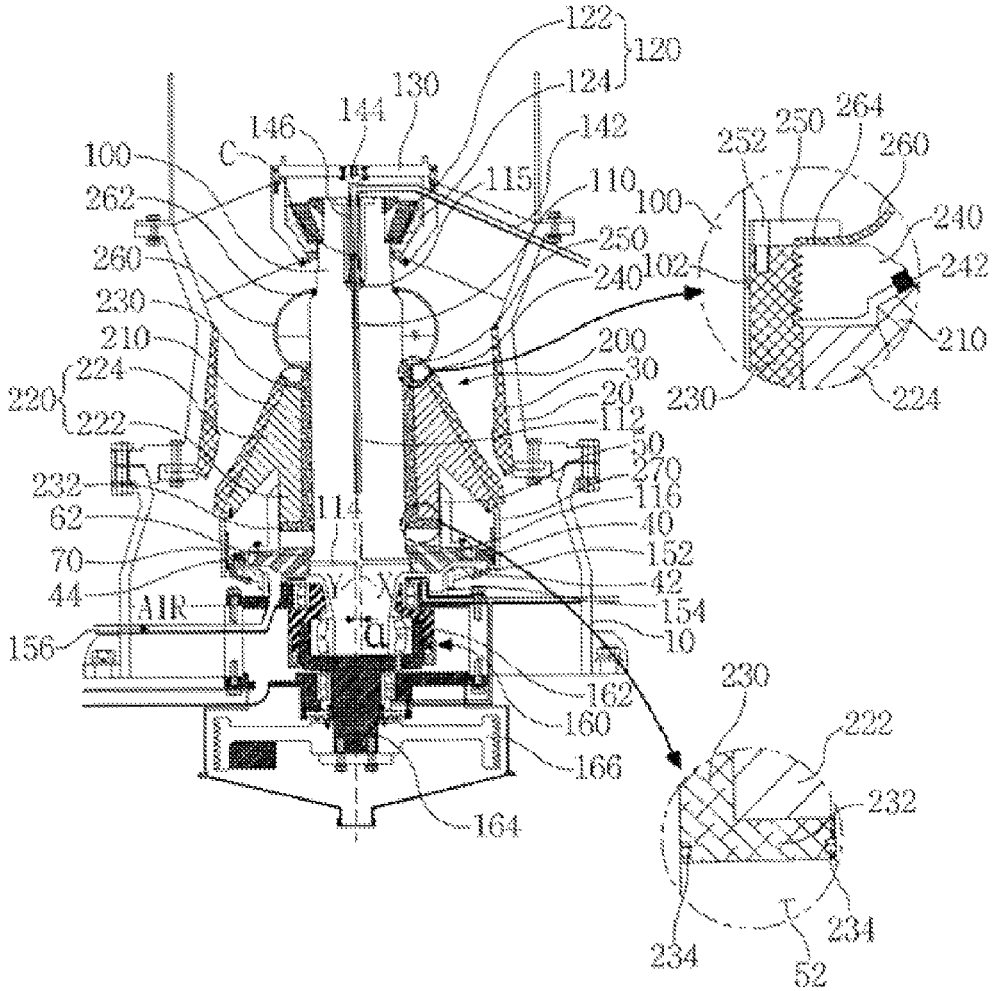
FIG. 1 is a sectional view illustrating a cone-shaped crusher according to first embodiment.

Hereinafter, cone-shaped crushers according to some embodiments of the present disclosure will be described in detail with reference to the accompanying drawings.

Cone crushers, Gyratory crushers, and the like are commonly referred to as cone-shaped crushers in the following description.

The terms and words used in the description and claims of the application should not be limited or interpreted as common or dictionary meanings, but should be interpreted as meanings and notions that conform with the technical ideas of the disclosure, on the basis of the principal in which the notions of the terms can be appropriately defined in order for the inventor to describe his disclosure in the best way. Thus, since the embodiments described in the present description and the configurations illustrated in the drawings are merely exemplary embodiments of the disclosure, and do not represent all the technical ideas of the disclosure, it should be understood that the disclosure covers various equivalents and modifications that can replace these embodiments of the configurations when the present application is filed.

For convenience and clearness of description, in the drawings, the sizes of respective constituent elements or specific parts are exaggerated, are omitted, or are schematically illustrated. Therefore, the sizes of the respective constituent elements do not reflect actual sizes completely. If it is thought that specific descriptions regarding the relevant publicly-known functions or configurations make the key point of the disclosure unnecessarily ambiguous, such descriptions will be omitted.

FIG. 1 is a sectional view illustrating a cone-shaped crusher according to a first embodiment.

Referring to FIG. 1, the conical crusher according to the first embodiment includes a frame having a cavity formed therein, a main shaft 100 disposed in the cavity of the frame eccentrically from the center axis of the frame to perform a gyratory movement, a mantle core assembly 200 which is coupled to the main shaft 100 for maintaining a common gyratory movement and is movable along longitudinal direction of the main shaft 100, and a concave 30 mounted on the inner circumferential surface of the frame that faces the mantle core assembly 200. The conical crusher further includes a crushing gap control support 40 which is located below the mantle core assembly 200 and is fixed to the main shaft 100, an eccentric driver 160 for driving the main shaft 100 to be eccentrically offset from a center axis (Y) of the frame, a main shaft driving means for rotating the eccentric driver 160 to generate the gyratory movement of the main shaft 100, and a suspension bearing 120 located at an upper end of the main shaft 100 for radially and vertically supporting the main shaft 100 to permit the gyratory movement of the main shaft 100.

The frame may be consist of a main frame 10 and a top frame 20 which is coupled to the upper portion of the main frame 10. The top frame may be consist of single or plural story-members.

The main shaft's lower end is accommodated inside of the main frame 10 and its upper end which passes through the concave 30 is housed in the top frame 20. In addition, the main shaft 100 makes the gyratory movement. Compared to the gyratory movement, there is little or no upward or downward movement of the main shaft.

Like other typical cone crushers, the cone crusher according to the first embodiment is supplied with objects to be crushed like rocks from above its top frame 20, the main shaft 100 and the mantle core assembly 200 mounted to main shaft are in the gyratory movement, and the objects are crushed between the concave 30 and the mantle 210 and falls down from the main frame 10.

In order to introduce the main technical idea of present disclosure, the first embodiment will be described not about the conventional details of the typical cone-shaped crushers but mainly about the distinctive features.

The main shaft 100 has an internal hydraulic oil passage 110 adapted to carry hydraulic oil for raising and lowering the mantle core assembly 200. The hydraulic oil passage 110 may comprises a vertical hydraulic oil passage 112 formed longitudinally in the main shaft 100 and one or more horizontal hydraulic oil passages 114 formed horizontally at the lower end of the vertical hydraulic oil passage 112.

The hydraulic oil passages 112, 114 are just examples of oil passages that may be formed on the main shaft 100, and it would be sufficient if the main shaft 100 has internal oil passages for communicating with the interior space 52 of cylindrical unit 50 to be described below. In addition, it is desirable that the main shaft 100 has a stepped part 116 at its outer peripheral surface for being mounted with a crushing gap control support 40 (to be described later) below the mantle core assembly 200.

The crushing gap control support 40 serves to support the longitudinal force of the mantle 210 resulted from crushing of the objects and provides a mount for the attachment of the cylindrical unit 50 described below.

The mantle core assembly 200 has a mantle core 220 which is shaped like a truncated cone and mounted on the main shaft 100, a mantle 210 which is shaped as a hollow truncated cone and covers outer surface of the mantle core 220, and a lock nut 240 for securely fastening the mantle 210 to the mantle core 220.

The mantle core 220 may comprise a mantle rest 224 for seating the mantle 210 on and a piston unit 222 formed at lower part of the mantle core which will be inserted in the cylindrical unit 50 to be described later.

Although FIG. 1 illustrates the mantle core 220 as a single rigid body, it is all right to alternatively have separate mantle rest 224 and piston unit 222 joined together to be the mantle core 220. In the latter case, the relative position of the piston unit 222 to the mantle core 220 is fixed after coupling it to the mantle rest 224.

A tubular mantle core sleeve 230 may be interposed between mantle core assembly 200 and the main shaft 100. A flange 232 extending outwardly in a radial direction is formed at lower end of the mantle core sleeve 230, the top surface of which is in contact with the bottom surface of the piston unit 222, thus the bottom surface of the piston unit 222 is covered by the flange 232.

The ring-shaped cylindrical unit 50 is formed on the crushing gap control support 40. The cylindrical unit 50 surrounds the outside of the piston potion 222 and extends from the crushing gap control support 40 toward the lower surface of the mantle core assembly 200.

The inner peripheral surface of the cylindrical unit 50 faces the outer peripheral surface of the piston unit 222 and remains spaced apart from the outer peripheral surface of the main shaft 100. In addition, the cylindrical unit 50 defines an internal space 52 where the hydraulic oil flows in and out. The piston 222 can be moved upward and downward along the longitudinal direction of the main shaft 100 by the pressure of the hydraulic oil that flows into and out from the internal space 52.

Meanwhile, as shown in FIG. 1, the horizontal hydraulic oil passages 114 formed in the main shaft 100 may communicate with the internal space 52 of the cylindrical unit 50 via hydraulic oil passages 62 formed in the crushing gap control support 40.

Alternatively, the outlets of the horizontal hydraulic oil passages 114 may be in direct communication with the internal space 52. In this case, the horizontal hydraulic oil passages 114 are formed at a position slightly higher than that as illustrated in FIG. 1. For example, the outlets of the horizontal hydraulic oil passages 114 may be formed right above the top surface of the crushing gap control support 40, which is in contact with the internal space 52.

According to the first embodiment, the cylindrical internal space 52 is partitioned by the inner surface of the cylindrical unit 50, the outer surface of the main shaft 100, the lower surface of the flange 232 formed at the lower end of the mantle core sleeve 230 and the top surface of the crushing gap control support 40.

The most likely point in the cylindrical internal space 52 to leak the hydraulic oil is a gap between the inner peripheral surface of the cylindrical unit 50 and the flange 232 or a gap between the outer peripheral surface of the main shaft 100 and the flange 232. Therefore, in order to prevent leakage of hydraulic oil, seal members 234 made of rubber or the like are preferably installed on the inner and outer peripheral surfaces of the flange 232.

Although the first embodiment illustrates that the mantle core sleeve 230 and the piston unit 222 are configured to be separate from each other, the mantle core sleeve 230 and the piston unit 222 may be modified into an integral configuration.

In addition, since said modification to the first embodiment omits the mantle core sleeve 230, the cylindrical internal space 52 is partitioned by the inner surface of the cylindrical unit 50, the outer surface of the main shaft 100, the lower surface of the piston unit 222 and the top surface of the crushing gap control support 40.

In this case, the most likely point in the internal space 52 of the cylindrical unit 50 to leak the hydraulic oil is a gap between the inner peripheral surface of the cylindrical unit 50 and the piston unit 222 or a gap between the outer peripheral surface of the main shaft 100 and the piston unit 222. Therefore, in order to prevent leakage of hydraulic oil, the seal members 234 made of rubber or the like are preferably installed on the inner and outer peripheral surfaces of the piston unit 222.

Figure 2:
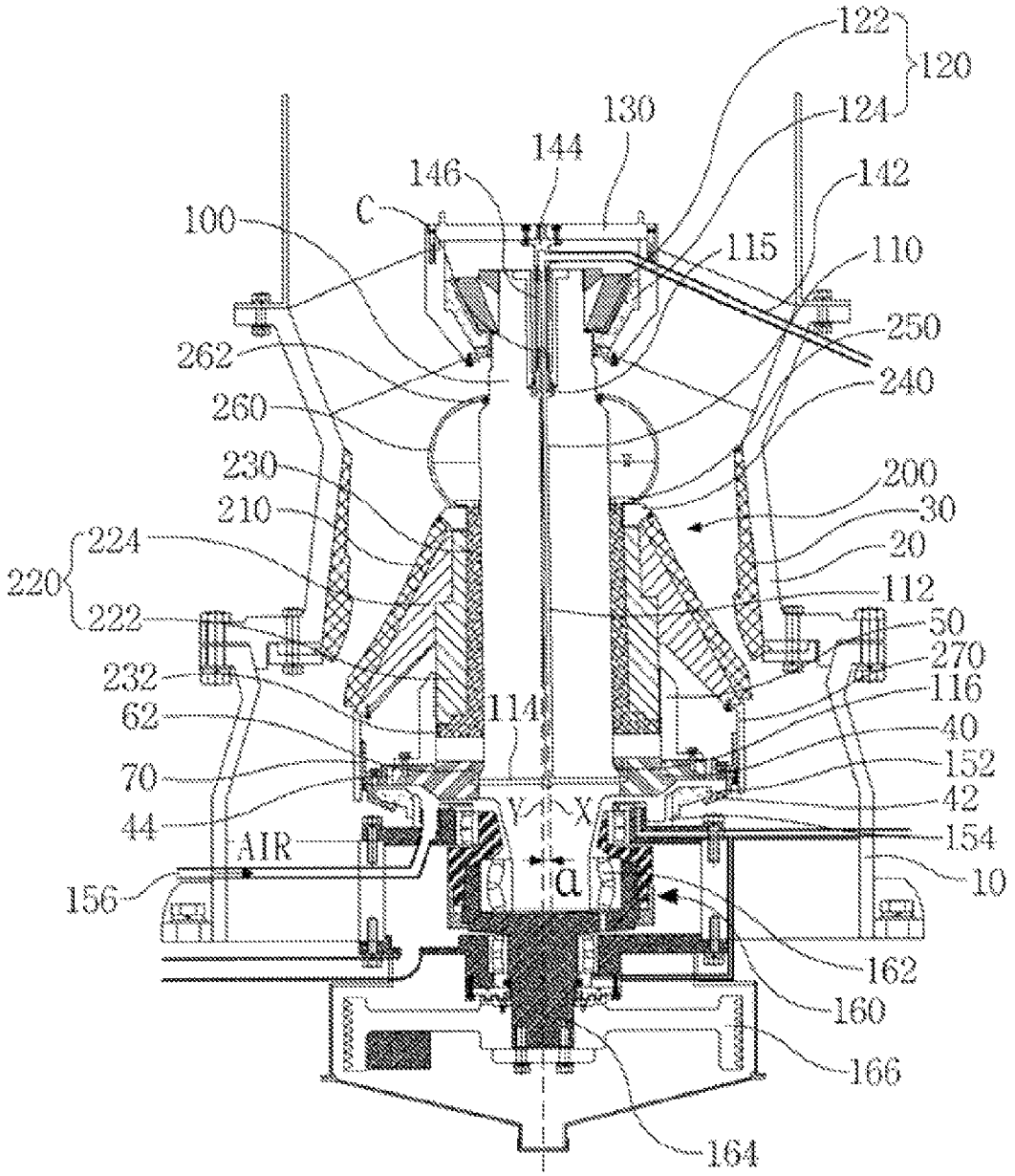
FIG. 2 is a sectional view illustrating a cone-shaped crusher according to second embodiment.

FIG. 2 is a sectional view illustrating a cone-shaped crusher according to second embodiment which is different from the first embodiment in that mantle core 220 is made of two divided components which are assembled together. The mantle core 220 may be made of more than two components, too. Like the first embodiment, the second embodiment may adopt a structure having the mantle core sleeve 230 installed inside the mantle core 220 or an integral structure of the mantle core sleeve 230 and the piston unit 222.

The description will be continued for the conical crusher according to the first embodiment.

To prevent the foreign matter such as dust and stone dust heavily generated from the objects that have been crushed between the concave 30 and the mantle 210 from being introduced into cylindrical unit 50 and the piston unit 222, the first embodiment has a first dust seal sleeve 70 installed on the crushing gap control support 40 and a second dust seal sleeve 270 installed on the mantle core 220.

The first dust seal sleeve 70 has a diameter larger than that of the cylindrical unit 50 and forms an annular sleeve extending from the crushing gap control support 40 toward the lower surface of the mantle core assembly 200.

The second dust seal sleeve 270 extending from a lower edge of the mantle rest 224 of the mantle core 220 toward the crushing gap control support 40 is an annular sleeve surrounding the outer circumferential surface of the first dust seal sleeve 70.

Since the second dust seal sleeve 270 is mounted to and moved up and down with the mantle core assembly 200, while the crushing gap is constantly adjusted by the movement of the conical crusher, the inner circumferential surface of the second dust seal sleeve 270 will be moved up and down along the outer peripheral surface of the first dust seal sleeve 70.

In addition, considering foreign matters such as dust and stone dust generally travel downward from the top of the conical crusher, the second dust seal sleeve 270 can be designed long enough to drape the outer peripheral surface of the first dust seal sleeve 70 as shown in FIG. 1, which is advantageous in the aspect of preventing foreign matters from flowing in through the gap between the first and second dust seal sleeves 70 and 270.

The first and second dust seal sleeves 70 and 270 are spaced apart from each other by a small gap maintained therebetween, and they are prevented from contacting each other even in the operation of the conical crusher. To fill this gap, the first dust seal sleeve 70 may be installed at its upper and outer circumferential end with a seal of a resilient material such as rubber or wool and coated with a lubricant such as grease.

The eccentric driver 160 has an eccentric bearing 162 for accommodating the lower end of the main shaft 100 and an eccentric drive shaft 164 which is the own rotating shaft of the eccentric driver 160. Fixed to the lower end of the eccentric drive shaft 164 is a pulley 166 which receives a driving force delivered by belts and the like connected to a motor, engine or other power sources.

The eccentric drive shaft 164 is coaxial with central axis Y of the frame, and the eccentric bearing 162 is formed coaxially with the central axis X of the main shaft 100. Accordingly, when the eccentric drive shaft 164 is rotated by driving the motor or engine, the main shaft 100 makes the gyratory movement in a position tilted from the frame central axis Y by an angle $\alpha$ formed between the frame central axis Y and central axis X of the main shaft 100. Here, the motor or engine corresponds to the main shaft driving means for driving the main shaft 100 into the gyratory movement.

In order for the main shaft 100 to make the gyratory movement, the main shaft 100 needs to be supported with its upper end moving less than its lower end, and for this need, the top end of the main shaft 100 is inserted to be supported in a top bearing chamber 130 which is fixed to the upper portion of the top frame 20.

The lower portion of the top bearing chamber 130 has a formation of an opening in which the upper end of the main shaft 100 is inserted. In addition, the upper end of the main shaft 100 is relieved from friction with the suspension bearing 120 comprising a rotating ring 122 and a stationary ring 124.

The rotatable ring 122 is securely fastened to the upper end of the main shaft 100, and the stationary ring 124 is seated in the inner peripheral surface of top bearing chamber 130. The outer peripheral surface of the rotatable ring 122 and the inner peripheral surface of the stationary ring 124 both have diameters decreasing gradually downward. Even when the main shaft's own weight tends to move the rotatable ring 122 downward, the outer peripheral surface of the rotatable ring 122 keeps in contact with the inner peripheral surface of the stationary ring 124 so that the rotatable ring 122 can be supported by the stationary ring 124. Therefore, the main shaft 100 is prevented from falling off the top bearing chamber 130.

The point indicated by C in FIG. 1 corresponds to the focal point of the gyratory movement of the main shaft 100, and, theoretically, there exhibits no motion at all. And since point C of the gyratory movement is located closer to the upper end than the opposite end, the main shaft 100 gyrates with much larger radius at its lower end than the upper end.

A cylindrical recess is formed on the upper end of the main shaft 100, and it is preferable to be recessed down below the level of focal point C of the gyratory movement.

A hydraulic oil conduit 146 of a resilient material is inserted in the cylindrical recess with a space maintaining a predetermined distance from the inner peripheral surface of the cylindrical recess. A conduit fixing part 144 fixes the hydraulic oil conduit 146 to the top bearing chamber 10. The inner diameter of the cylindrical recess is preferably determined so that the hydraulic oil conduit 146 does not touch the inner peripheral surface of the cylindrical recess even at the gyration movement of the main shaft 100.

Connected to the conduit fixing part 144 is an outer hydraulic oil inlet pipe 142 serving as a passage for the hydraulic oil supplied externally, and the upper end of the vertical hydraulic oil passages 112 is connected by a communicating connector 115 to the hydraulic oil conduit 146. Here, focal point C of the gyratory movement is preferably located on the hydraulic oil conduit 146, whereby minimizing a deformation of the hydraulic oil conduit 146.

The hydraulic oil is supplied from a source to the interior space 52 of the cylindrical unit 50 while passing through the outer hydraulic oil inlet pipe 142, conduit fixing part 144, hydraulic oil conduit 146, communicating connector 115, vertical hydraulic oil passage 112, horizontal hydraulic oil passage 114 and the hydraulic oil passages 62 in this order.

The hydraulic oil conduit 146 is preferably formed with a flexible material, and in this case, the hydraulic oil conduit 146 flexes in response to the rocking of the upper end of the main shaft 100 and maintains a stable connection between the conduit fixing part 144 and the communicating connector 115 to allow the hydraulic oil to travel reliably in and out of the interior space 52 of the cylindrical unit 50 even at the gyration movement of the main shaft 100.

The hydraulic oil conduit 146 is preferably pliable as stated above, and more preferably it is formed of a material with a higher resistance to longitudinal forces. Therefore, the present disclosure contemplates using a rubber hose reinforced at its outer periphery surface with, for example iron or such metal wire.

In order to prevent foreign matters from entering between the eccentric driver 160 and the crushing gap control support 40, a dust seal is formed therebetween.

The dust seal comprises a gyrating spherical ring 42, a fixed spherical ring 152 and a fixed spherical ring guide 154. The gyrating spherical ring 42 is fixed by bolts or the like to the lower edge of the crushing gap control support 40, and the bottom surface of the fixed spherical ring 152 is seated on the top surface of the gyrating spherical ring 42. In addition, the fixed spherical ring 152 is inserted around the spherical ring guide 154 and is movable vertically.

The top surface of the gyrating spherical ring 42 is formed to be spherical having the focal point C of the gyratory movement as its center, and the bottom surface of the fixed spherical ring 152 is formed to be spherical with the same curvature as the top surface of the gyratory spherical ring 42. This can minimize the gap between the contact surfaces of the fixed spherical ring 152 and the gyrating spherical ring 42, to minimize the entry of foreign matters through the gap.

Meanwhile, in order to positively cut off inflow of foreign materials between the eccentric driver 160 and the crushing gap control support 40, the internal space of the fixed spherical ring guide 154 has an air path 156 connected thereto. Compressed air is applied to the internal space of the fixed spherical ring guide 154 to expel dust and such waste to the outside as it clears the crusher through a gap between the gyrating spherical ring 42 and the fixed spherical ring 152 and a gap between the fixed spherical ring 152 and the spherical ring guide 154. Further, the compressed air acts through an air hole 44 to a space between the first dust seal sleeve 70 and the second dust seal sleeve 270 for blocking dust from entering the crusher.

As previously described, the tubular mantle core sleeve 230 may be interposed between the mantle core assembly 200 and the main shaft 100. In the first embodiment, the mantle core sleeve 230 is inserted in the cavity formed in the center of the mantle core 220, and once the mantle core sleeve 230 is inserted in the mantle core 220 until the lower portion of the piston unit 222 of the mantle core 220 abuts the upper surface of the flange 232 of the mantle core sleeve 232, the upper end of the mantle core sleeve 230 protrudes above the upper end of the upper mantle core 220. In addition, threads are formed in the upper outer peripheral surfaces of the mantle core sleeve 230.

Upon seating the mantle 210 on the mantle rest 224 of the mantle core 220, by mounting and fastening the lock nut 240 to the outer peripheral surface of the upper end of the mantle core sleeve 230, the mantle core sleeve 230 is securely coupled to the mantle core 220, and the mantle 210 is pressed against the mantle rest 224 under the depression of the lock nut 240. In addition, installed between the lock nut 240 and the mantle 210 may be a torch ring 242 which facilitates releasing the lock nut 240 when replacing the mantle 210 by melting away the torch ring 242 with a torch.

In the first embodiment, when the mantle core sleeve 230 is securely coupled to the mantle core 220 by the lock nut 240, the mantle core sleeve 230 and the mantle core 220 move together integrally without a relative movement as if mantle core sleeve 230 is an integral part of mantle core assembly 200. Accordingly, the gap between the main shaft 100 and the mantle core assembly 200 is defined herein to refer to the gap 102 formed between the outer peripheral surface of the main shaft 100 and the inner peripheral surface of the mantle core sleeve 230.

On the other hand, as shown in the modification of the first embodiment described above, when the mantle core sleeve 230 and the piston unit 222 are integrated in a single body, the gap between the main shaft 100 and the mantle core assembly 200 is defined to refer to a gap formed between the outer peripheral surface of the main shaft 100 and the inner peripheral surface of the mantle core 220.

In order to prevent the inflow of foreign matters between the main shaft 100 and the mantle core assembly 200, the main shaft 100 is fitted with a tire-shaped sealer 260.

The tire-shaped sealer 260 has an upper inner diameter portion 262 arranged in contact with the outer peripheral surfaces of the main shaft 100 and a lower inner diameter portion 264 affixed to the upper end of the mantle core assembly 200.

The diameter of the upper inner diameter portion 262 may be determined to be somewhat smaller than its counterpart from the main shaft 100 so that the upper inner diameter portion 262 of the tire-shaped sealer 260 can be resiliently deformed to seal tightly the outer periphery of the main shaft 100.

The lower inner diameter portion 264 of the tire-shaped sealer 260 is fixed by at least one clamp 250 to the upper end of the mantle core assembly 200.

The clamp 250 may be formed with an annular member configured to fixedly depress the lower inner diameter portion 264 of the tire-shaped sealer 260 onto the lock nut 240 or to the upper end of the mantle core sleeve 230. In FIG. 1, the clamp 250 is depicted as being fixed to the upper end of the mantle core sleeve 230 by a fixing bolt 252 which, however, is not necessarily fastened to the upper end of the mantle core sleeve 230. For example, the fixing bolt 252 may be coupled directly to the lock nut 240 at a location radially outward in the clamp 250 than that shown in FIG. 1.

While the lock nut 240 and the clamp 250 pinch the lower inner diameter portion 264 of the tire-shaped sealer 260 immovably therebetween, they may be formed with irregularities such as roughened surfaces or concave-convex surfaces for providing an enhanced fixation.

In particular, irregularities are formed on at least one of a surface of the lock nut 240 in contact with the lower inner diameter portion of the tire-shaped sealer 260 and the surface of the clamp 250 in contact with the lower inner diameter 264 of the tire-shaped sealer 260.

An injection of lubricant, for example, grease may be provided in a space defined by the tire-shaped sealer 260 and the main shaft 100. Thanks to the excellent sealing of the lower inner diameter portion 264 of the tire-shaped sealer 260, which is established by the clamp 250 and the lock nut 240, the lubricant is stopped from leaking through the clamp 250 or the lock nut 240. The lubricant injected into the space is used for lubricating the outer peripheral surface of the main shaft 100 against the inner peripheral surface of the mantle core assembly 200.

When crushing the objects with the main shaft 100 in gyratory motion generated by the eccentric driver 160 and the main shaft driving means, the inner peripheral surfaces of the mantle core assembly 200 will be pushed hard against the outer peripheral surfaces of the main shaft 100. To the contrary, the opposite side of the forced side by the rock has an increased gap 102 between the inner peripheral surfaces of the mantle core assembly 200 and the outer peripheral surfaces of the main shaft 100.

Into this gap 102 does the lubricant which was first injected into the space defined between the tire-shaped sealer 260 and the main shaft 100 flow intensively.

To be exact, since the circumferential length of the inner peripheral surface of the mantle core assembly 200 is longer than the circumferential length of the outer peripheral surface of the main shaft 100, the mantle core assembly 200 rides the main shaft 100 around its outer peripheral surfaces maintaining a line contact therebetween. Then, as the gyratory movement progresses, linear contact portion between the mantle core assembly 200 and the main shaft 100 will move along the circumferential direction of the main shaft 100. This is translated into the movement of the gap 102 between the inner peripheral surfaces of the mantle core assembly 200 and the outer peripheral surfaces of the main shaft 100, along the same circumferential direction of the main shaft 100.

Eventually, the lubricant flows along the gap 102 as the gap 102 moves circumferentially of the main shaft 100 and thereby provides a uniform injection thereof all over the outer peripheral surfaces of the main shaft 100 and the internal peripheral surfaces of the mantle core assembly 200.

Figure 3:
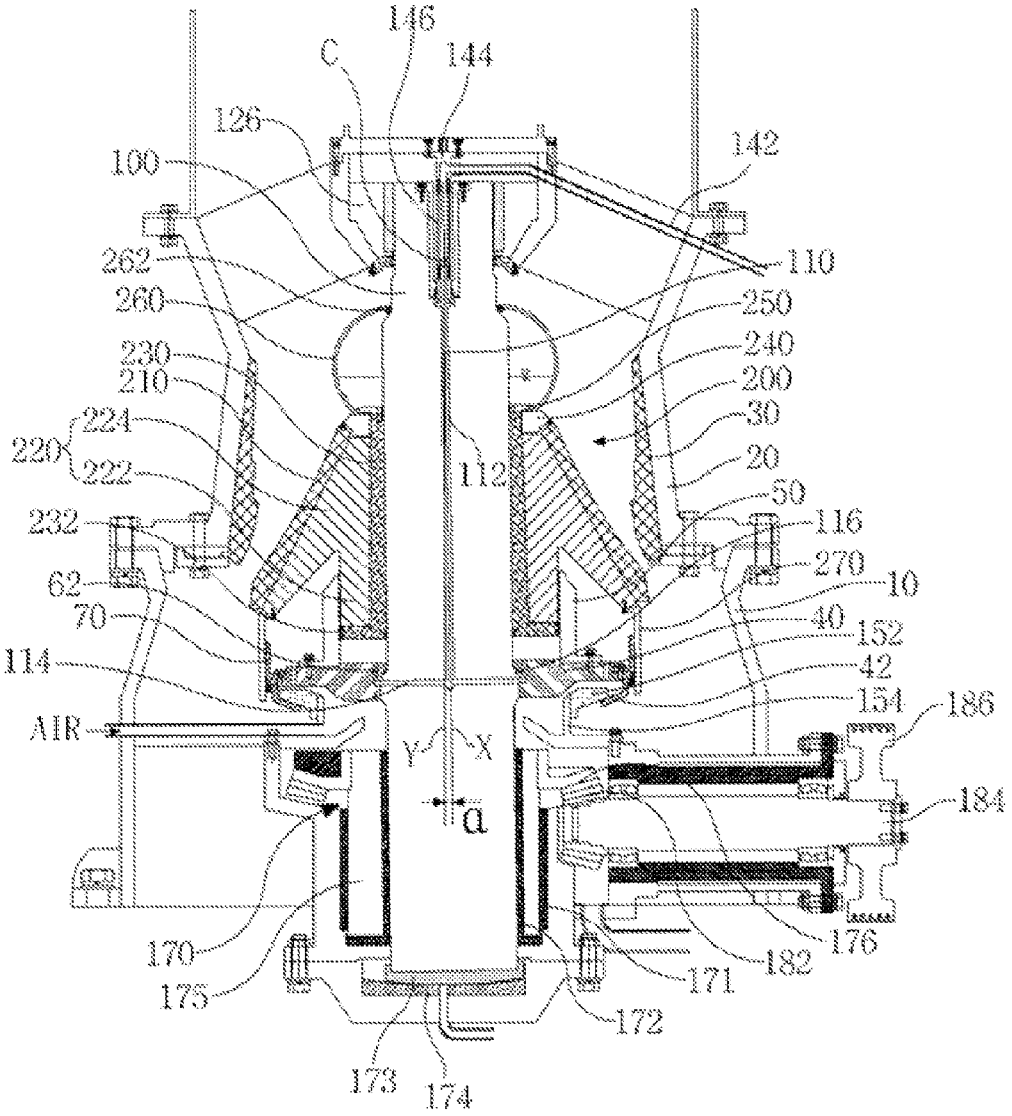
FIG. 3 is a sectional view illustrating a cone-shaped crusher according to third embodiment.

FIG. 3 is a sectional view showing a conical crusher according to a third embodiment of the present disclosure.

In the following description of the third embodiment referring to FIG. 3. To avoid repeated description, distinctive features from the first embodiment will be rather discussed. Compared to the first embodiment, the third embodiment has a different eccentric driver 170 and a different driving means for the main shaft and replaces the suspension bearing 120 by a conventional bearing 126.

In the third embodiment, the eccentric driver 170 is provided with an eccentric sleeve 175 equipped with journaled bearings 171 and 172 and a bevel gear 176 formed on the external periphery surfaces of the eccentric sleeve 175. Accepting the lower end of the main shaft 100 in its eccentric center bearing, the eccentric sleeve 175 itself rotates in a coaxial arrangement with central axis Y.

Inserting the lower end of the main shaft 100 into the eccentric sleeve 175 will tilt central axis X of the main shaft 100 by angle $\alpha$ from central axis Y of the frame. In addition, coupled to the lower end of the main shaft 100 is a convex spherical thrust bearing 173 which is supported by a concave spherical thrust bearing 174. Further, the concave spherical thrust bearings 173 and 174 are supplied with lubricating oil between them.

Due to the ability of concave spherical thrust bearings 173 and 174 to support the longitudinal component force of the main shaft 100 transmitted from the crushed objects, the bearing 126 adequate just for the radial forces may be used to bear the upper end of the main shaft 100.

In order to rotate the eccentric driver 160, a main shaft drive means such as a motor or engine is provided.

A shaft 184, which has a pinion gear 182 adapted to mesh with the bevel gear 176 at one end and a pulley 186 at the other end, may receive the driving force by belts and the like. The rotational force of the driven shaft 184 can rotate the eccentric driver 160 and drive the main shaft 100 to do gyratory movement.

The remaining arrangements except the eccentric driver 160, and the bearings 126, 173, 174 used for the support of upper and lower ends of the main shaft 100, are the same as those of the first embodiment.

According to the cone shaped crushers of the present disclosure described above, even when the mantle core 220 and the main shaft 100 gyrate while the inner peripheral surfaces of the mantle core 220 (or the inner peripheral surface of the mantle core sleeve 230) and the outer peripheral surfaces of the main shaft 100 are in strong contact to each other, there is no sliding friction that causes surface breakage between the two major components. In addition, since the lubricant injected into the space defined between the tire-shaped sealer 260 and the main shaft 100 makes the rolling friction between two surfaces even smooth. Furthermore, this lubricant also lubricates the mantle core assembly 200 and the main shaft 100 therebetween.

In addition, since the cone shaped crusher of the present disclosure does not forcibly restrain but permits the relative rotation between the mantle core assembly 200 and the main shaft 100, no key and key groove are required to be formed between the two components.

For the lack of a key and a key groove between the mantle core assembly 200 and the main shaft 100, there is no risk of stress concentration at their contact surfaces, and the structural strength of the mantle core assembly 200 and the main shaft 100 is maintained for extended term of operation.

Furthermore, the piston unit 222 and the cylindrical unit 50 are shielded from the exterior space by the first and second dust seal sleeves 70 and 270, there is substantially no chance of contamination by dust or other foreign matters.

Although the invention has been described by means of the limited embodiments and drawings, the disclosure is not limited thereby, but those having ordinary knowledge in the art will apparently appreciate that various modifications and alterations are possible within the scope of the technical idea of the disclosure and the scope of the equivalents of the claims set forth below.

The invention claimed is:

1. A cone-shaped crusher comprising:

a frame with a cavity formed therein;

a main shaft disposed in the cavity of the frame eccentrically from a center axis of the frame to perform a gyratory movement;

a mantle core assembly which is coupled to the main shaft for a common gyratory movement with the main shaft, wherein the mantle core assembly rides the main shaft around an outer peripheral surface of the main shaft and maintains a line contact between the mantle core assembly and the outer peripheral surface;

a crushing gap control support positioned below the mantle core assembly and fixed to the main shaft;

an annular cylindrical unit surrounding the outside of the main shaft and extending from the crushing gap control support toward the lower surface of the mantle core assembly; and a piston unit configured to be in a fixed relative position with respect to the mantle core assembly, formed at the lower portion of the mantle core assembly, inserted in the cylindrical unit, and movable up and down by a pressure of hydraulic oil flowing in and out of an internal space of the cylindrical unit.

2. The cone-shaped crusher of claim 1, wherein the main shaft internally has a formation of one or more hydraulic oil passages which are in direct communication with the internal space of the cylindrical unit or in communication with the internal space of the cylindrical unit via the crushing gap control support.

3. The cone-shaped crusher of claim 1, further comprising seal members provided on each of the outer peripheral surface and the inner peripheral surface of the lower end of the piston unit to prevent leakage of hydraulic oil.

4. The cone-shaped crusher of claim 1, wherein the mantle core of the mantle core assembly is composed of more than one piece.

5. The cone-shaped crusher of claim 1, further comprising a mantle core sleeve interposed between the mantle core and the main shaft.

6. The cone-shaped crusher of claim 5, wherein the mantle core sleeve has a flange which contacts and covers the bottom surface of the piston unit.

7. The cone-shaped crusher of claim 6, wherein further comprising seal members provided on each of an outer peripheral surface and an inner peripheral surface of the lower end of the flange to prevent leakage of hydraulic oil.

8. The cone-shaped crusher of claim 1, further comprising means for preventing inflow of foreign matters to the piston unit and the cylindrical unit, the means for preventing the inflow comprises:

a first dust seal sleeve having a larger diameter than that of the cylindrical unit and extending from the crushing gap control support to the lower surface of the mantle core assembly; and a second dust seal sleeve extending from the lower surface of the mantle core assembly to the crushing gap control support and surrounding the outer circumferential surface of the first dust seal sleeve.

9. The cone-shaped crusher of claim 1, further comprising a tire-shaped sealer for preventing inflow of foreign matters between the main shaft and the mantle core assembly, the tire-shaped sealer having an upper inner diameter portion being in contact with the outer circumferential surface of the main shaft and a lower inner diameter portion fixed to the upper end of the mantle core assembly.

10. The cone-shaped crusher of claim 9, further comprising a clamp for fixing the lower inner diameter portion of the tire-shaped sealer to the upper end of the mantle core assembly.

11. The cone-shaped crusher of claim 10, wherein the mantle core assembly has a mantle core mounted on the main shaft, a mantle for externally covering the mantle core, and a least one lock nut for fastening the mantle to the mantle core, and wherein the lower inner diameter portion of the tire-shaped sealer is compressed in place between the lock nut and the clamp.

12. The cone-shaped crusher of claim 11, wherein irregularities are formed on at least one of a surface of the lock nut in contact with the lower inner diameter portion of the tire-shaped sealer and a surface of the clamp in contact with the lower inner diameter of the tire-shaped sealer.

13. The cone-shaped crusher of claim 9, wherein an injection of a lubricant is provided in a space defined by the tire-shaped sealer and the main shaft.

14. The cone-shaped crusher of claim 1, further comprising:

an eccentric driver configured to drive the main shaft to be eccentrically offset from a center axis (Y) of the frame; and a main shaft driving means configured to rotate the eccentric driver to generate a gyratory movement of the main shaft.

* * * * *